US008186756B2

(12) United States Patent
Jørgensen

(10) Patent No.: US 8,186,756 B2
(45) Date of Patent: May 29, 2012

(54) ADJUSTABLE BODY SUPPORT

(75) Inventor: Knud Jørgensen, Odder (DK)

(73) Assignee: R82 A/S, Gedved (DK)

( * ) Notice: Subject to any disclaimer, the term of this patent is extended or adjusted under 35 U.S.C. 154(b) by 24 days.

(21) Appl. No.: 12/803,702

(22) Filed: Jul. 2, 2010

(65) Prior Publication Data

US 2011/0001341 A1 Jan. 6, 2011

(30) Foreign Application Priority Data

Jul. 3, 2009 (DK) ..... 2009 00824

(51) Int. Cl.
*A47C 7/02* (2006.01)
*A47C 3/00* (2006.01)

(52) U.S. Cl. ..... 297/230.12; 297/284.9

(58) Field of Classification Search ..... 297/230.13, 297/230.12, 230.1, 230.14, 284.3, 440.1, 297/284.9

See application file for complete search history.

(56) References Cited

U.S. PATENT DOCUMENTS

| | | | | |
|---|---|---|---|---|
| 6,032,975 | A * | 3/2000 | Hanson et al. | 280/647 |
| 6,059,370 | A * | 5/2000 | Kanyer et al. | 297/452.36 |
| 6,257,664 | B1 * | 7/2001 | Chew et al. | 297/284.9 |
| 6,460,933 | B1 * | 10/2002 | Bors et al. | 297/440.2 |
| 6,659,563 | B2 * | 12/2003 | Float et al. | 297/440.2 |
| 6,688,693 | B2 * | 2/2004 | Christofferson et al. | 297/354.12 |
| 2003/0164639 | A1 * | 9/2003 | Infanti | 297/440.1 |
| 2008/0284222 | A1 * | 11/2008 | Draeger et al. | 297/284.3 |
| 2010/0276974 | A1 * | 11/2010 | Huttenhuis | 297/284.3 |

FOREIGN PATENT DOCUMENTS

| | | |
|---|---|---|
| DE | 102007046713 | 4/2009 |
| FR | 2469315 | 5/1981 |

* cited by examiner

*Primary Examiner* — Milton Nelson, Jr.
(74) *Attorney, Agent, or Firm* — James Creighton Wray

(57) ABSTRACT

An adjustable body support, including a number of mutually displaceable members, where a first plate-shaped basic member includes means for releasable fastening on a piece of furniture, a second plate-shaped basic member includes means for releasable fastening to the first basic member at varying positions, and a number of support members that may be releasably fastened to the second basic member.

5 Claims, 3 Drawing Sheets

ADJUSTABLE BODY SUPPORT

FIELD OF THE INVENTION

The present invention concerns an adjustable body support for use in supporting parts of the body, including in particular the back and particularly for persons with handicaps, weak back or similar.

BACKGROUND OF THE INVENTION

It is known to use various types of body supports, in particular in connection with individual adaptation of wheelchairs and other sitting furniture for particularly handicapped persons, or persons with a deficiency, in particular in the spine, entailing that they use much time in sitting or lying positions, and in some cases have difficulties in keeping themselves upright in a chair or a seat by their own strength.

Moreover, it is known that some of these supports, especially side supports, have possibility of adjusting the support in width as well as in height, and in some cases also in depth. Common to many of these solutions is, however, that tools are to be used for adjusting the support as initially it has been the intention that the support was only to be used by a certain user, and therefore the support may be adapted once and for all for exactly this user. Therefore, it is not a problem with the prior art that a tool is to be used since this adjustment, as already mentioned above, is only to occur once. Moreover, these types of supports are of such a kind that they are intended for adjustment while the user is not in the chair or bed when mounting the support in the chair or bed and adjusted correctly in relation to the user.

Due to a disabled person's limited freedom and ability of moving in a controlled way/manner, there is thus a need for ensuring the best possible support as well as to avoid moving the disabled person to the greatest possible extent, but anyway be able to provide comfortable and fixed positions for the support. This fact, compared with the fact that most disabled persons in need of these supports also have a need for help from an assistant, often result in a difficult and relatively heavy task for an assistant of changing the settings of the support in order to provide a comfortable position for the user.

An example of an adjustable body support is disclosed in U.S. Pat. No. 6,032,975. This device however comprises a number of parts, such that adjustment of the support with respect to the individual users needs requires a relatively large number of parts to be moved. In this process it is very difficult exactly to arrive at the desired support, as one member may unintentionally be displaced relative to another member.

OBJECT OF THE INVENTION

It is thus the purpose of the present invention to provide a solution that takes account of the disadvantages by the prior art.

DESCRIPTION OF THE INVENTION

The present invention solves these problems by means of an adjustable body support, including a number of mutually displaceable members, where a first plate-shaped basic member includes means for releasable fastening on a piece of furniture, a second plate-shaped basic member includes means for releasable fastening to the first basic member at varying positions, and a number of support members that may be releasably fastened to the second basic member.

By thus providing a number of interacting elements that may be adjusted in relation to each other, a very great freedom with regard to adjusting the body support is provided, as well as the first plate-shaped basic element includes means for fastening the body support to a piece of furniture so that the body support can be retrofitted in many of the other aids or furniture located either in the user's own home or when visiting other locations, as e.g. cinemas, theatres, doctors, hospitals and similar.

In a further preferred embodiment, in the second basic member there are provided an oblong slot largely at the centre of the member and in parallel with two sides and a number of lesser secondary slots perpendicularly to and at both sides of the oblong slot, separated from the latter by plate material, and that in the first basic member there are provided holes and/or slots interacting with fastening means whereby the first and second basic members may be fixed relatively.

By using an oblong slot in the second basic member, this may be displaced in relation to the first basic element and thereby in relation to the piece of furniture upon which the first plate-shaped basic element is fastened. This means that even by apparent unsuitable furniture, such as e.g. low chairs and the like, it is possible to provide the optimal sitting comfort and support for a user.

The smaller secondary slots perpendicularly to the oblong slot serve to mount the support members such that the body part or parts to be supported can be supported correctly with regard to the position desired to be used by the user in the furniture in question.

In a further preferred embodiment, this is also supported by the support members including fastening means that may be fixed in the secondary slots in the second basic member.

In order to achieve as easily operated and flexible design as possible, the invention is designed in a further preferred embodiment such that the secondary slots in the second basic member are designed with a circular part with a first radius in open connection with a slot section, where the width of the slot is less than the first radius, and where the fastening means on the support members have a fastening member including three parts:

- a first lower part having a cross-section with a maximum dimension less than the first radius, but greater than the width of the slot;
- a second centre part with a cross-section less than the width of the slot;
- a third retainer part with a cross-section greater than the first radius.

By this method of fastening it is very easy to finely adjust the support precisely for the given situation and also to insert or remove supports that are either to be used as additions or which are superfluous, respectively.

In a further preferred embodiment of the adjustable body support, but in particular the fastening means, these are characterised in that the first lower part and the second centre part of the fastening member are one integrated rotationally symmetric member in which an internal screw threaded part and an inner first retainer flange are provided in a central hole, and where in the third retainer part there is provided an inner opening such that the second central part may be arranged coaxially and axially displaceable within this opening, and further that internally of the opening there is provided a second retainer flange, and further that an axial boring is provided through the support member itself, in which boring a clamping element is disposed, the clamping element being provided with an external screw thread at one end, the screw thread interacting with the internal threaded part in the first lower part.

By this design, allowance is made for adjusting, fastening and release of the support members may occur from a position relative to the user which does not require the user to be moved from the support or in other way be troubled in connection with changing/adjusting the body support. By thus providing a clamping element with a relatively long shaft through the support member itself, the clamping and thereby adjustment and disposition of the support member be controlled from the outermost part of the support member, i.e. the one farthest away from the backrest, in such a way that the user will not necessarily interfere with the adjustment itself.

In a further preferred embodiment, the invention can be used in connection with furniture to which the first plate-shaped member can be fastened, this being a chair, a wheelchair, a cinema chair, a sofa, a seat for a car, train, coach or airplane, or a therapy couch, and where the means for fastening include one or more of bolts, straps, belts, clips, special fittings or brackets.

By thus having the great flexibility provided by the present invention, it is possible to use the body support in connection with particularly sitting furniture which are not specially designed for meeting the needs of e.g. a disabled person, but where these needs can be met by mounting a body support according to the invention.

DESCRIPTION OF THE DRAWING

The invention will now be explained in more detail with reference to the accompanying drawing, in which one embodiment of the invention will be described in detail.

DETAILED DESCRIPTION OF EMBODIMENTS OF THE INVENTION

Figure 1:
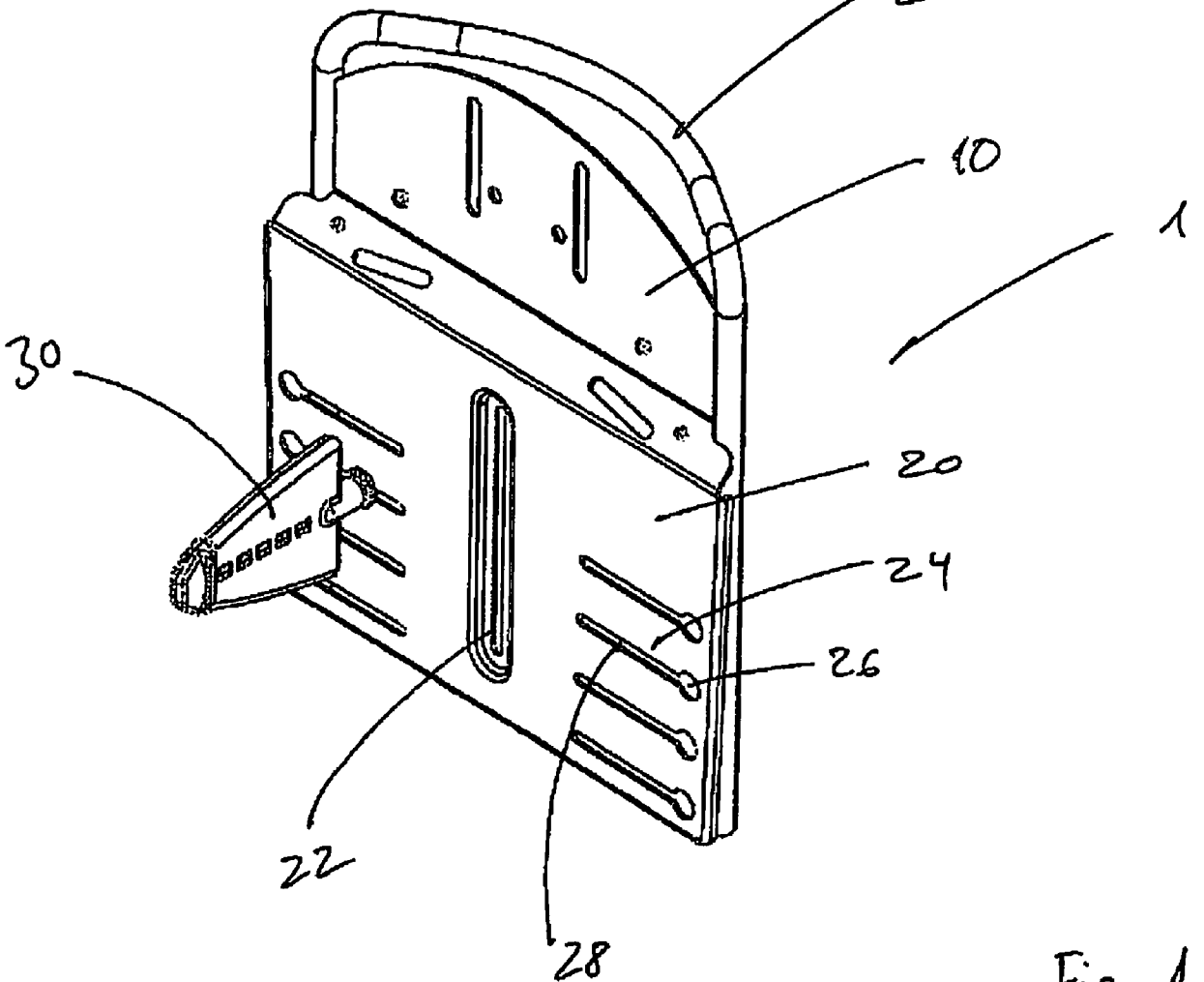
FIGS. 1 and 2 illustrate a support according to the invention.
Figure 2:
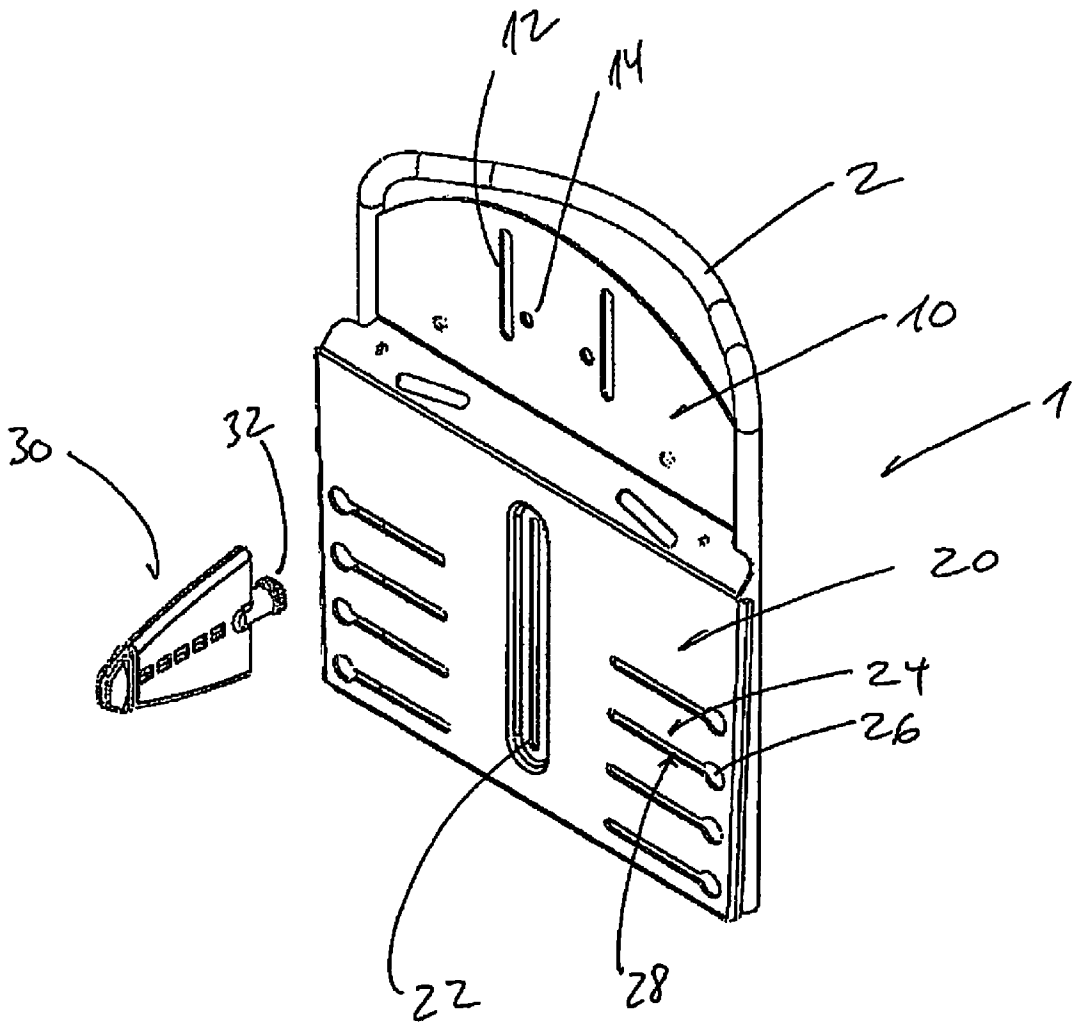

In FIGS. 1 and 2 are illustrated a body support according to the invention, where the body support 1 in this case is a back support mounted on the backrest 2 on a chair. A plate-shaped basic member 10 is fitted on the backrest 2 of the chair. The fastening itself of the basic member 10 to the chair 2 will not be described in any detail, but may be executed in a plurality of different ways.

Externally of the plate-shaped basic member 10 there is mounted a second plate-shaped basic member 20. An oblong slot 22 is provided in the second plate-shaped basic member 20. Correspondingly, a series of holes or corresponding slots are provided in the first plate-shaped basic member such that fastening means, e.g. in the form of a bolt, may be inserted in the slot 22 and a hole or a slot (not shown) in the first basic member 10, and by tightening the bolt the second basic member 20 can be fixed relatively to the first basic member 10 at a given height.

In the second basic member 20 there is furthermore provided a number of secondary slots 24 perpendicularly to the oblong slot 22. The secondary slots 24 are designed to receive a support member 30, this being described in more detail with reference to FIGS. 3 and 4.

The support member 30 is designed such that at fastening member 32 may be inserted in a circular part 26 provided in the secondary slots 24. The circular part 26 is in open connection with the body 28 of the secondary slot so that when the fastening member 32 of the support member is inserted in the circular part 26, the support member 30 may be displaced along the body 28 of the slot, after which the support member cannot be drawn out perpendicularly to the plane of the second basic member.

In the first plate-shaped basic member, additional slots and holes 12, 14 are provided which may typically be used for attaching adjustable headrests and similar.

Figure 4:
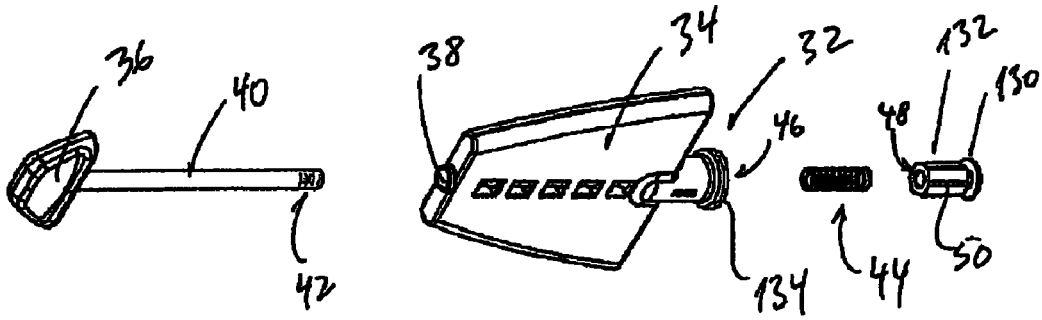
FIGS. 3 and 4 illustrate a support member in assembled state and in exploded view, respectively.
Figure 3:
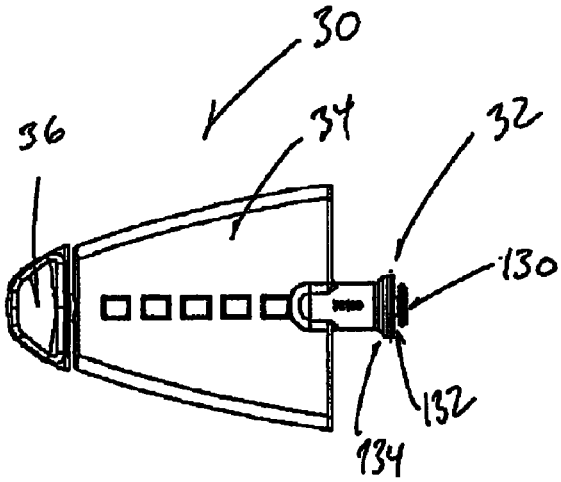

Turning to FIGS. 3 and 4, a preferred embodiment of the support member 30 will be explained.

In FIG. 3 is shown an assembled support member 30. The support member 30 consists of a fastening member 32, a body part 34 and a fastening member 36.

The fastening member 32 consists of a first lower part 130, a central part 132 and a retainer part 134. The cross-section of the lower part 130 is less than a radius of the circular part 26 of the secondary slots 24. The cross-section of the central part 132 is less than the width of the body part 28 of the secondary slots 24. Correspondingly, the cross-section 134 of the retainer part is greater than the width of the body parts 28 of the secondary slots, and in many cases greater than the circular part 26 of the secondary slots 24.

This means that it is possible to insert the lowermost part 130, which is a fastening device, in the circular part 26 of the secondary slots 24 as illustrated in FIG. 1, and by displacing the support member 30 along the body part 28 of the secondary slots 24, the retainer part 134 will prevent the support member 30 from being pushed farther into the second plate-shaped basic member 20, and the dimension of the lower part which is greater than the width of the slot 28 in the secondary slots 24 will prevent the support member 30 from being pulled out of the secondary slots 24.

Between the lowermost part 130 and the fastening device 36, a shaft is provided internally of the body 34 of the support member, the shaft being fastened to the fastening means 36 and via a screw thread displaceably attached to the lowermost part 130 of the fastening device. Then, by turning the fastening device 36, the distance between the lowermost part 130 and the retainer part 134, i.e. the width of the central part 130, may be adjusted such that the support member 30 can be clamped around the secondary slots 24 on the secondary plate-shaped basic member.

Referring to FIG. 4, the construction appears in exploded view. It appears that an axial boring 38 is provided in the body part 34 of the support member. The axial boring 38 is designed such that the rod 40 can be inserted coaxially, and by means of the screw thread 42 which interacts with an internal screw thread in the central part 132 of the fastening means, the distance between the retainer part 134 and the lowermost part 130 mentioned above may be varied by turning the fastening means 36 and thereby activate the screw threads 42, either in one or the other direction.

In order to ensure as little play in the design as possible and to keep the central part 132 as open as possible, a spring 44 is provided which holds the fastening means 36 against the end of the coaxial boring 38, also pushing the lowermost element 130 as far as possible away from the retainer part 134. Internal flanges acting as rest for the spring 44 are provided internally of the borings 46, 48 in retainer parts 134 and the central part 132.

In the shown embodiment, the lowermost part and the central part 130, 132 are designed as an integrated element which additionally is provided with guide ribs 50 that interact with corresponding grooves provided in the boring 46.

The above describes a relatively specific embodiment of the invention, but it is obvious that the invention can be made in various ways within the protective scope provided by the accompanying claims.

The invention claimed is:

1. An adjustable body support, including a number of mutually displaceable members, where a first plate-shaped basic member (10) includes means for releasable fastening said body support to a piece of furniture (2), a second plate-shaped basic member (20) includes means (22) for releasable fastening said second basic member to the first basic member (10) in varying positions, and a number of support members (30) that may be releasably fastened to the second basic member (20), wherein an oblong slot is provided in the second basic member largely at the centre of the member and in parallel with two sides and a number of lesser secondary slots are provided perpendicularly to and at both sides of the oblong slot, separated from the latter by plate material, and that holes and/or slots interacting with fastening means are provided in the first basic member whereby the first and second basic members may be fixed relatively.

2. Adjustable body support according to claim 1, wherein the furniture to which the first plate-shaped member can be fastened is a chair, a wheelchair, a cinema chair, a sofa, a seat for a car, train, coach or airplane, or a therapy couch, and where the means for fastening include one or more of bolts, straps, belts, clips, special fittings or brackets.

3. Adjustable body support according to claim 1, wherein the support members include fastening means that may be fixed in the secondary slots in the second basic member.

4. Adjustable body support according to claim 3, wherein the secondary slots in the second basic member are designed with a circular part with a first radius in open connection with a slot section, where the width of the slot is less than the first radius, and where the fastening means on the support members have a fastening member including three parts: a first lower part having a cross-section with a maximum dimension less than the first radius, but greater than the width of the slot; a second centre part with a cross-section less than the width of the slot; a third retainer part with a cross-section greater than the first radius.

5. Adjustable body support according to claim 4, wherein the first lower part and the second centre part of the fastening member are one integrated rotationally symmetric member in which an internal screw threaded part and an inner first retainer flange are provided in a central hole, and where in the third retainer part there is provided an inner opening such that the second central part may be arranged coaxially and axially displaceable within this opening, and further that internally of the opening there is provided a second retainer flange, and further that an axial boring is provided through the support member itself, in which boring a clamping element is disposed, the clamping element being provided with an external screw thread at one end, the screw thread interacting with the internal threaded part in the first lower part.

* * * * *